US005286400A

United States Patent [19]

Paszek et al.

[11] Patent Number: 5,286,400

[45] Date of Patent: Feb. 15, 1994

[54] FLOWABLE POWDER CARPET CLEANING FORMULATIONS

[75] Inventors: Leon E. Paszek, Mountainside; Jeanne M. Weller, Glen Rock, both of N.J.

[73] Assignee: Eastman Kodak Company, Rochester, N.Y.

[21] Appl. No.: 38,389

[22] Filed: Mar. 29, 1993

[51] Int. Cl.[5] ..... C11D 3/382; C11D 3/02; C11D 3/08

[52] U.S. Cl. ..... 252/88; 252/135; 252/174.17; 252/174.12; 8/137; 8/142

[58] Field of Search ..... 252/88, 135, 174.17, 252/174.25, 174.12; 8/137, 142

[56] References Cited

U.S. PATENT DOCUMENTS

| | | | |
|---|---|---|---|
| 3,736,259 | 5/1973 | Buck et al. | 252/89 |
| 4,395,347 | 7/1983 | McLaughlin et al. | 252/139 |
| 4,493,781 | 1/1985 | Chapman et al. | 252/88 |
| 4,648,882 | 3/1987 | Osberghaus et al. | 8/142 |
| 4,659,494 | 4/1987 | Soldanski et al. | 252/88 |
| 4,834,900 | 5/1989 | Soldanski et al. | 252/88 |

FOREIGN PATENT DOCUMENTS

| | | |
|---|---|---|
| 0062536 | 10/1982 | European Pat. Off. . |
| 59-161500 | 9/1984 | Japan . |

*Primary Examiner*—Paul Lieberman
*Assistant Examiner*—Kery A. Fries
*Attorney, Agent, or Firm*—John R. Everett

[57] ABSTRACT

A flowable powder fabric dry cleaning formulation is disclosed. The formulations contains powdered cellulose, borax hydrated amorphous silica, anionic surfactants, an organic solvent, water; and a zeolite.

9 Claims, No Drawings

FLOWABLE POWDER CARPET CLEANING FORMULATIONS

FIELD OF THE INVENTION

The present invention relates to textile cleaning formulations.

BACKGROUND OF THE INVENTION

Powdered cleaning formulations for dry cleaning carpets and other textiles are known. The formulations generally contain surfactants, absorbants and water. In use the powder is brushed into the carpet fibers; allowed to absorb the soil. After drying the carpet is then vacuumed thereby removing the soil laden powder leaving a clean carpet.

Various absorbants have been used, ranging from clays to dried corn cobs, a combination of cellulose fibers, powdered borax, wood flour and fumed silica. Both cellulose fibers and borax have been used as absorbants but not in the same formulation. See U.S. Pat. Nos. 4,659,494, 4,834,900 and 4,395,347.

Zeolites, natural and synthetic, in combination with surfactants and organic solvents (nonaqueous) have also been used in formulations for dry cleaning textiles. See U.S. Pat. No. 4,648,882.

The problem is that such prior art formulations are not complete cleaning systems. For example, water must be added before use. Moreover the formulations are fluffy causing difficulties in filling containers during manufacture. These powders have very poor flowing characteristics that make effective dispersals on carpets difficult.

SUMMARY OF THE INVENTION

The present invention provides a flowable powder fabric dry cleaning composition comprising:

a) 20 to 50 parts of powdered cellulose;
b) 10 to 25 parts of borax
c) 0 to 10 parts of hydrated amorphous silica;
d) 0 to 10.0 parts of one or more anionic surfactants;
e) 0.5 to 10.0 parts of an organic solvent;
f) 30.0 to 60 parts water; and
g) 0 to 10.0 parts of a zeolite; provided that at least one of the silicas or zeolite is always present in the composition.

In the formulations of this invention up to 70 parts of liquid can be absorbed by the absorbant components a), b) and c) of the invention. The composition is flowable allowing even coverage during dispersal on carpets. It brushes easily into carpets and is easily vacuumed out of carpets.

DETAILS OF THE INVENTION

The formulations comprise a unique absorbant component in combination with a liquid cleaner component resulting unexpectedly in a white flowable powder.

The liquid component consists of a mixture of water, solvents and anionic surfactants. Small amounts of fragrances and other adjuncts may also be blended into the liquid cleaning component.

In addition to water present in amount of 30 to 60 parts, preferably 35 to 55 parts, an organic solvent is present in a concentration of from 0.5 to 10.0 parts, preferably 4 to 8 parts. Useful organic solvents can be water-miscible or water immiscible. They should not adversely affect textiles and be sufficiently volatile to evaporate in a reasonable time of about 10 to 45 minutes after application to textiles. They should have a high enough flash point to avoid danger of fire and should be toxicologically acceptable. Alcohols, ketones, glycol ethers and hydrocarbon such as ethanol isopropanol, propoxy propanol, 3-methoxy-3-methyl butanol, acetone, ethers of mono- and diethylene glycol and mono-, di-, and tripropylene glycols, etc.

The surfactant component of the liquid cleaner portion of the formulation is present in a concentration of 0.1 to 10.0 parts, preferably 0.25 to 3.0 parts. A wide variety of anionic surfactants are suitable. The list includes those of the sulfate or sulfonate type, although other types can also be employed, such as soaps, long-chain N-acylsarcosinates, salts of fatty acid cyanamides or salts of ether carboxylic acids, of the type obtainable from long-chain alkyl or alkylphenyl polyglycol ethers and chloracetic acid. The anionic surfactants are preferably used in the form of the sodium salts.

Particularly suitable surfactants of the sulfate type are the sulfuric acid monoesters of long-chain primary alcohols of natural and synthetic origin containing from 10 to 20 carbon atoms, i.e. fatty alcohols, such as, for example, coconut oil fatty alcohols, tallow fatty alcohols, oleyl alcohol, or $C_{10}$–$C_{20}$-oxo-alcohols and those of secondary alcohols having the same chain lengths. Other suitable surfactants of the sulfate type are sulfuric acid monoesters of aliphatic primary alcohols, secondary alcohols or alkylphenols ethoxylated with from 1 to 6 moles of ethylene oxide. Sulfated fatty acid alkanolamides and sulfated fatty acid monoglycerides are also suitable.

Surfactants of the sulfonate type are, primarily, sulfosuccinic acid mono- and diesters containing 6 to 22 carbon atoms in the alcohol portions, alkylbenzene sulfonates containing $C_9$–$C_{15}$ alkyl groups and esters of -sulfofatty acids, for example, the sulfonated methyl or ethyl ester of hydrogenated coconut oil, palm kernel oil or tallow fatty acids. Other suitable surfactants of the sulfonate type are the alkane sulfonates obtainable from $C_{12}$–$C_{18}$ alkanes by sulfochlorination or sulfoxidation, followed by hydrolysis or neutralization, or by the addition of bisulfites onto olefins, and also olefin sulfonates, i.e. mixtures of alkene and hydroxyalkane sulfonates and disulfonates of the type obtained, for example, from long-chain monoolefins containing a terminal or internal double bond by sulfonation with gaseous sulfur trioxide, followed by alkaline or acidic hydrolysis of the sulfonation products.

$C_{12}$–$C_{18}$ fatty alcohol sulfates, the salts of sulfosucinic acid monoesters containing from 16 to 20 carbon atoms in the alcohol portion and mixtures of these surfactants are particularly preferred.

Borax, in a weight concentration of 10 to 25 parts, preferably 10 to 20 parts, in decahydrate form or as decahydrated sodium tetaborate is an essential absorbant. The term "borax" includes all of its possible forms. The basic feature of the borax is that it is capable of increasing the apparent density of the cleaning formulation and of existing in agglomerated form so as to facilitate the application of the formulation onto the carpet surface without excessive dusting or uneven distribution. It also serves to enhance and facilitate the cleaning performance and the subsequent removal of the formulation. Of prime importance, the borax will not adhere to the carpet regardless of the moisture content of the formulation. Accordingly, it may be readily removed from the carpet by vacuuming without reducing the efficiency of the vacuuming operation, as by clogging of the system.

Cellulose powders, in a concentration of 20 to 50 parts, preferably 25 to 40 parts, suitable for use as part of the absorbant component of the formulation are obtained from commercial cellulose, which is generally obtained from vegetable sources, more particularly from wood, by size-reduction using mechanical and/or chemical processes. Powders such as these, which are colorless and substantially free from lignin and other impurities associated with the vegetable material, are commercially available in different finenesses, although it is only the finer types with particle sizes of from 1 to 150 microns that are suitable for the purposes of the invention. A particularly high cleaning powder is developed by formulations containing cellulose powder having a particle size of from 1 to 90 microns and preferably from 5 to 50 microns.

Hydrate amorphous silicas and synthetic precipitated silicas add flowability to the formulations. Amorphous silicas are available commercially as Hi-Sil from PPG.

Any natural or synthetic zeolites, or mixtures of both, at concentration of 0 to 10 parts, preferably 1 to 7 parts, that have a capacity to absorb liquid systems and regulate the rheological properties of the powder composition, such as flowability can also be included in the formulations of the invention. In the formulations of this invention zeolite reduces the feel of drag on carpeting after the carpet has been cleaned. Representatives zeolites included the so-called A type described U.S. Pat. No. 4,304,675 and other well know publications. The preferred types are sodium aluminumsilicate available as zeolites Na-A from PQ Corporation and known as VALFOR 100 OR and Union Carbide's ZB-100.

The production of the formulations is technically simple. Mostly single-stage processes can be used. well known mixers, such as paddle mixers or drum mixers, or augers mixers can be used. The absorbants and, optionally, other finely divided solid components are initially introduced into the mixture in which they are then sprayed while mixing with the liquid cleaning component while mixing is continued. The absorbants and the liquid components are each premixed. After thorough blending the preblended liquid components are sprayed on to the premixed powder and mixed until a smooth flowable powder is produced.

The following examples illustrate the superior properties of the formulations of the invention.

Textiles and carpets are cleaned by scattering the cleaning formulations according to the invention onto the textiles either by hand or by means of a suitable appliance and then rubbing them more or less intensively into the textiles, for example, by means of a sponge or brush. In general, the rubbing-in times are between 0.5 to 2.5 minutes and preferably between 0.5 and 1.5 minutes per square meter. After the formulations have been rubbed in, the textiles are left to dry until the formulations which combine with the dirt have changed into dry residues. These residues are then removed from the textiles mechanically, for example, by brushing out or by vacuum cleaning. For the surface cleaning of textiles, the formulations of the invention are used in quantities of from 20 to 200 g/m$^2$, depending on the fullness of the textiles and their degree of soiling, although they can also be locally applied in larger quantities for removing individual stains. For the surface cleaning of carpets, the formulations of the invention are normally used in quantities of from 50 to 150 g/m$^2$.

The process as a whole can be carried out largely by hand, for example, in the home, although it is also possible to carry out the rubbing-in step and, optionally other steps by means of suitable appliances, for example, combined scattering and brushing machines, so that the process is equally suitable for use on an industrial scale.

EXAMPLE I

The following formulation of Table I was prepared according to the above described manufacturing procedure. The formulation was applied to a carpet as described the procedure for used also described above.

TABLE I

| Ingredient* | Amount (parts) |
|---|---|
| Powdered Cellulose (0.090 mm) | 30.00 |
| Borax decahydrate sodium borate (60/200 mesh) | 15.00 |
| Hydrated amorphous silica $S_1O_2$ or Valfor 100 zeolite | 5.00 |
| Ethanol | 3.00 |
| n-Propoxy Propanol | 3.00 |
| Cycloryl RS-25 | 3.00 |
| Fragrance | 0.01 |
| Water | 40.90 |

*The commercial sources for the ingredients are as follows:
1. Powdered cellulose supplied by Multi-Kem Corp. as Arbocel B-800.
2. Borax supplied by U.S. Borax Co.
3. Amorphous Silica supplied by PPG Industries under the trade name of Hi-Sil 233.
4. n-Propoxy Propanol supplied by Union Carbide as Propyl Propasol Solvent.
5. Cycloryl RS-25 (renamed RHODATERG RS-25) is an aqueous rug shampoo concentrate of, by our analysis, 21.5 weight % sodium lauryl sulfate and 3.5 weight % sodium sulfosuccinate supplied by Rhone Poulenc Co.

During preparation of this formulation it was discovered that an excess of liquid will convert the wet powder to a paste. Addition of more cellulose failed to change the paste back to a powder. However, the addition of very small amounts of the amorphours silica returns the paste to a flowable powder. The silica acts as a agglomerator controlling agent.

Evaluation of this formulation in use on rugs disclosed the following advantages over some commercially available dry carpet cleaners:

1. This formulation has a superior absorbant system, composed of cellulose, borax and amorphous silica; it's advantages over other absorbants is as follows:

a) Lower cost, better oil absorbance and no residual formaldehyde compared to cleaners that use urea formaldehyde resin as an absorbant.

b) White color, non flammable and better absorbant than wood flour, used in some commercial cleaners.

c) This formulation has a lighter density and is easier to vacuum from carpets than prior art clay absorbants.

2. The detergent system (surfactants and solvents) used in the formulation dries quickly to a friable foam that is easy to vacuum from a carpet and will not contribute to resoiling.

3. The formulation is an attractive, pleasantly scented, white flowable powder, that gives a signal, during cleaning, by turning darker as the soil is absorbed.

EXAMPLE II

The useful concentration range of each ingredient in the formulations of Example I is established in Table II. The concentration ranges were determined using the same method of making used in Example I. The powdered absorbants were varied while the liquid load was kept constant. The different formulations had substantially the same properties as the formulation of Example I except that formula A could not absorb the liquid load and formula D, without the amorphous silica or zeolite had a very light density and was difficult to disperse. The use of The different formulations had substantially the same properties as the formulation of Example I except that formula A could not absorb the liquid load and formula D, without the amorphous silica or zeolite, had a very light density and was difficult to disperse. Amorphous silica or a zeolite, as an agglomerating control agent was essential to forming a flowable powder. Powders that do not flow freely will be difficult for consumer use and also difficult to pack into containers during manufacture.

TABLE II

| | Weight % of Formula | | | | | |
|---|---|---|---|---|---|---|
| | A | B | C | D | E | F |
| Cellulose | 10.0 | 20.0 | 30.0 | 40.0 | 30.0 | 30.0 |
| Borax 60/200 | 35.0 | 25.0 | 15.0 | 10.0 | — | — |
| Borax 30/70 | — | — | — | — | 15.0 | — |
| Borax Extra Fine | — | — | — | — | — | 15.0 |
| Amorphous silica | 5.0 | 5.0 | 5.0 | — | 5.0 | 5.0 |
| Ethanol | 3.0 | 3.0 | 3.0 | 3.0 | 3.0 | 3.0 |
| Cycloryl RS-25 | 3.0 | 3.0 | 3.0 | 3.0 | 3.0 | 3.0 |
| Propoxy propanol | 3.0 | 3.0 | 3.0 | 3.0 | 3.0 | 3.0 |
| Fragrance oil | 0.1 | 0.1 | 0.1 | 0.1 | 0.1 | 0.1 |
| Water (Soft or D.I.) | 40.9 | 40.9 | 40.9 | 40.9 | 40.9 | 40.9 |
| Total | 100.0% | 100.0% | 100.0% | 100.0% | 100.0% | 100.0% |

EXAMPLE III

The composition of this example provides excellent flowability, cleaning and physical properties as in the case of Examples I and II. However the present of zeolite reduced any feeling of "drag" in the cleaned carpet. Drag is a dry feeling that a carpet may have after cleaning.

| | Parts |
|---|---|
| Cellulose | 30.0 |
| Borax | 15.0 |
| Zeolite (Valfor 100) | 5.0 |
| Solvent Mixture* | 6.0 |
| RhodaTerse RS 25 | 3.0 |
| Fragrance | 0.1 |
| Water | 40.9 |

The invention has been described in detail with particular reference to preferred embodiments thereof, but it will be understood that variations and modifications can be effected within the spirit and scope of the invention.

What is claimed is:

1. A flowable powder fabric dry cleaning formulation comprising:

a) 20 to 50 parts of powdered cellulose;
b) 10 to 25 parts of borax;
c) 0 to 10 parts of hydrated amorphous silica;
d) 0 to 10.0 parts of one or more anionic surfactants;
e) 0.5 to 10.0 parts of an organic solvent;
f) 30.0 to 60 parts water; and
g) 0 to 10.0 parts of a zeolite; provided that at least one of the silicas or the zeolite is always present in the formulation.

2. The formulation of claim 1 wherein the surfactant is selected from the group consisting of a) $C_{12}$–$C_{18}$ fatty alcohol sulfates containing from 16 to 20 carbon atoms in the alcohol portion, b) Alkylbenzene sulfonates containing $C_9$–$C_{15}$ alkyl groups; c) alkali alkyl sulfonates; and d) mixtures of one or more of such surfactants.

3. The formulation of claim 2 comprising from 0.25 to 3.0 parts surfactant.

4. The formulation of claim 1 wherein the organic solvent is selected from the group consisting of alcohols, glycols, glycol ethers and mixtures of such solvents.

5. The formulation of claim 4 comprising from 4.0 to 8.0 parts of the solvent.

6. The formulation of claim 1 comprising:

a) 30 parts of powdered cellulose;
b) 15 parts of borax;
c) 5 parts of a member selected from the group consisting of a) hydrated amorphous silicas; b)synthetic precipitated silicas; c) a zeolite d) and mixtures of a zeolite and a silica;
d) 0.75 parts of anionic surfactant;
e) 6 parts of organic solvent; and
f) 40 to 41 parts of water.

7. The formulation of claim 6 wherein the surfactant is a mixture of sodium lauryl sulfate and sodium sulfosuccinate; and the organic solvent contains equal parts of n-propoxy propanol and 3-methoxy-3-methyl butanol.

8. The formulation of claim 7 wherein the surfactant is a mixture of 86 parts of sodium lauryl sulfate and 14 parts of sodium sulfosuccinate.

9. The formulation of claim 6 wherein the zeolite is sodium aluminumsilicate.

* * * * *